US008434646B2

(12) United States Patent
Saveliev et al.

(10) Patent No.: US 8,434,646 B2
(45) Date of Patent: May 7, 2013

(54) MIXED BEVERAGE DISPENSE SYSTEM AND METHOD

(75) Inventors: Michael Saveliev, Huntington Beach, CA (US); Kevin Carlson, Chino Hills, CA (US); Steven T. Jersey, Laguna Niguel, CA (US); Paul H. Bertsch, Huntington Beach, CA (US)

(73) Assignee: Everpure, LLC, Hanover Park, IL (US)

( * ) Notice: Subject to any disclaimer, the term of this patent is extended or adjusted under 35 U.S.C. 154(b) by 435 days.

(21) Appl. No.: 12/560,320

(22) Filed: Sep. 15, 2009
(Under 37 CFR 1.47)

(65) Prior Publication Data

US 2010/0308078 A1 Dec. 9, 2010

Related U.S. Application Data

(60) Provisional application No. 61/097,168, filed on Sep. 15, 2008.

(51) Int. Cl.
*B67D 7/70* (2010.01)

(52) U.S. Cl.
USPC ..... 222/129.1; 222/129.3; 222/135; 222/318; 222/334; 222/67; 137/409; 137/607; 137/625.41

(58) Field of Classification Search ..... 222/129–129.4, 222/134, 135, 318, 334, 67; 137/409, 607, 137/625.41
See application file for complete search history.

(56) References Cited

U.S. PATENT DOCUMENTS

| | | | | |
|---|---|---|---|---|
| 3,876,114 | A | 4/1975 | Hicks et al. | |
| 3,902,636 | A | 9/1975 | Zilk | |
| 4,144,915 | A | 3/1979 | Henderson | |
| 4,356,937 | A | 11/1982 | Simon et al. | |
| 4,684,332 | A | 8/1987 | Hartley et al. | |
| 4,921,132 | A * | 5/1990 | Wales et al. | 222/57 |
| 5,011,043 | A | 4/1991 | Whigham et al. | |
| 5,082,143 | A | 1/1992 | Schramm, Jr. | |
| 5,350,083 | A | 9/1994 | Du | |
| 5,735,291 | A * | 4/1998 | Kaonohi | 137/337 |
| 6,719,175 | B2 | 4/2004 | Mackenzie et al. | |
| 6,997,200 | B2 * | 2/2006 | King | 137/1 |
| 7,334,600 | B2 * | 2/2008 | Scott | 137/202 |
| 7,967,037 | B2 * | 6/2011 | Foster et al. | 141/104 |
| 2004/0004010 | A1 | 1/2004 | Versluys | |
| 2006/0113323 | A1 | 6/2006 | Jones | |
| 2006/0138170 | A1 | 6/2006 | Brim et al. | |
| 2006/0169715 | A1 | 8/2006 | Emmendorfer et al. | |

FOREIGN PATENT DOCUMENTS

| | | |
|---|---|---|
| WO | WO2005/047171 | 5/2005 |

* cited by examiner

*Primary Examiner* — J. Casimer Jacyna

(74) *Attorney, Agent, or Firm* — Quarles & Brady LLP

(57) ABSTRACT

A mixed beverage dispense system and method for pumping a first liquid and a second liquid using a controlled gas source. The dispense system can include a first pump that pumps the first liquid and a second pump that pumps the second liquid. The first pump and the second pump can each include a gas inlet, an inlet gas connection, and an outlet gas connection. The dispense system can also include connector tubing connecting the controlled gas source to the first pump and the second pump in series. The dispense system can include a bag-in-box package with chambers that hold the liquid bags and a fitment with fitment openings open to each one of the chambers for receiving the liquids from the liquid bags. The dispense system can also include an outlet connector coupled to the fitment for receiving the liquids from the fitment.

11 Claims, 15 Drawing Sheets

MIXED BEVERAGE DISPENSE SYSTEM AND METHOD

RELATED APPLICATIONS

This application claims priority under 35 U.S.C. §119 to U.S. Provisional Patent Application No. 61/097,168 filed on Sep. 15, 2008, the entire contents of which is incorporated herein by reference.

BACKGROUND

Mixed beverage dispense systems can use one or more pumps to pump two liquids (e.g., liquor and mixer) to create a mixed beverage. In conventional dispense systems, a desired ratio of the two liquids is reached using taste tests. However, in some dispense systems, the ratio may change unexpectedly due to irregular pressures and flow rates in the liquid flow lines.

Most dispense systems pump liquor from liquor bottles connected to container wells. Current United States Alcohol, Tobacco, Firearms and Explosives (ATF) laws prevent liquor products from being packaged in containers or bags larger than 1.75 liters. As a result, liquor bottles in the dispense system must be replaced frequently, which can be inconvenient for a user. In addition, most conventional dispense systems do not have indicators to alert the user when the liquor runs out. Unless the user is frequently checking levels of liquor in the liquor bottle, it is common for the beverage dispenser to only dispense mixer for some period of time before the user realizes it.

SUMMARY

Some embodiments of the invention provide a mixed beverage dispense system for pumping a first liquid and a second liquid using a controlled gas source. The dispense system includes a first pump that pumps the first liquid and a second pump that pumps the second liquid. The first pump includes a first vacuum shutoff device, a first gas inlet, a first inlet gas connection, and a first outlet gas connection. The second pump includes a second vacuum shutoff device, a second gas inlet, a second inlet gas connection, and a second outlet gas connection. The dispense system also includes first connector tubing connecting the controlled gas source to the first gas inlet. The dispense system further includes second connector tubing connecting the first inlet gas connection to the second gas inlet. In addition, the dispense system includes third connector tubing connecting the second inlet gas connection to the first outlet gas connection and the second outlet gas connection, so that the first pump and the second pump are connected to the controlled gas source in series.

Some embodiments of the invention provide a dispense system for dispensing liquids from liquid bags using a pump. The dispense system includes a bag-in-box package with chambers that hold the liquid bags. The dispense system also includes a fitment with fitment openings open to each one of the chambers for receiving the liquids from the liquid bags. The dispense system further includes an outlet connector coupled to the fitment for receiving the liquids from the fitment. In addition, the dispense system includes tubing coupling the outlet connector to the pump.

DETAILED DESCRIPTION

Figure 1:
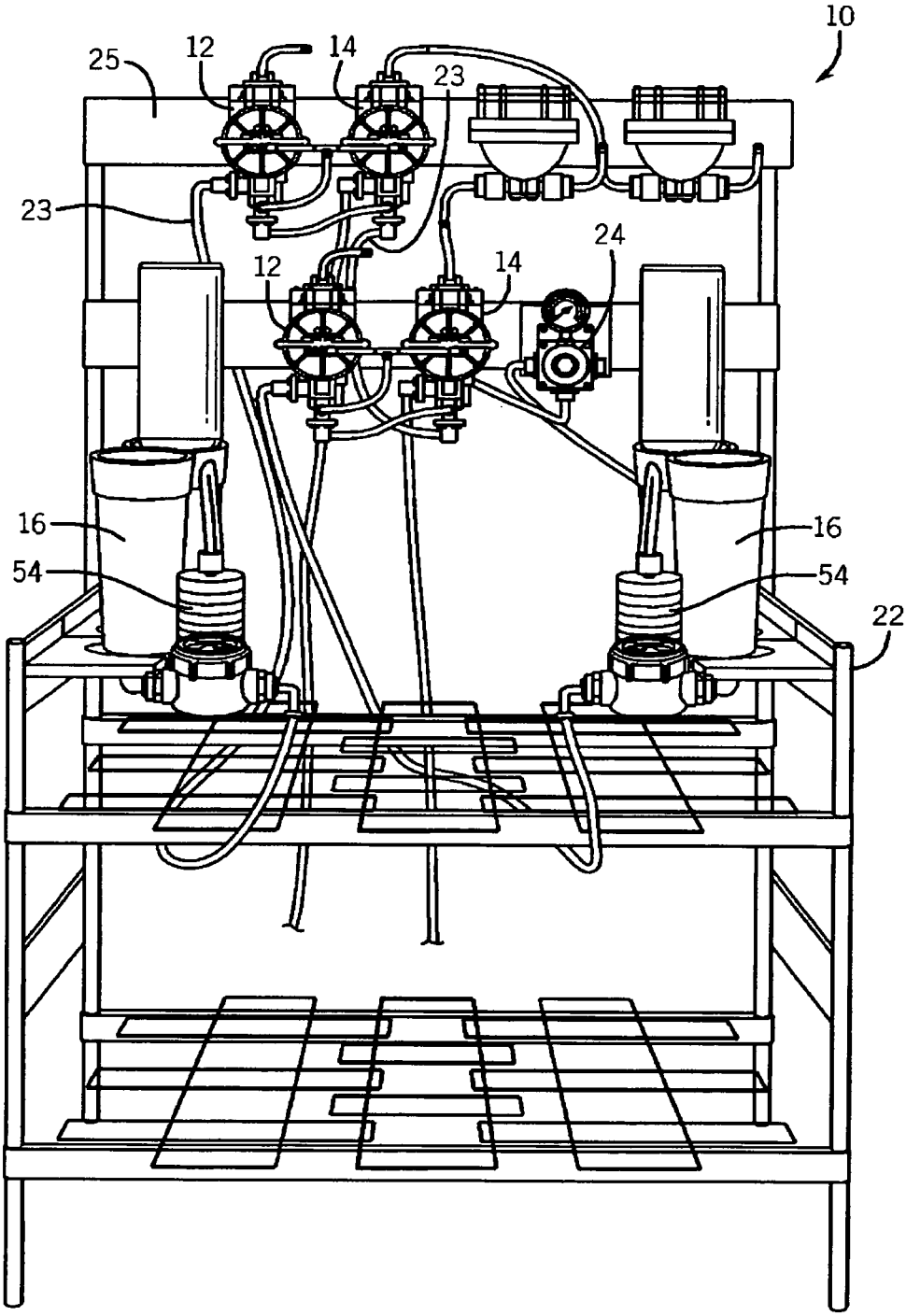
FIG. 1 is a perspective view of a mixed beverage dispense system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a mixed beverage dispense system 10 according to one embodiment of the invention. The dispense system 10 can include at least two gas-operated diaphragm pumps 12, 14 to pump two different liquids of a mixed beverage. In one embodiment, a first pump 12 can pump a first liquid, such as liquor from a container well 16 or a container open to atmosphere. A second pump 14 can pump a second liquid, such as a cocktail mixer from a conventional bag in box (BIB) package (not shown).

Figure 2:
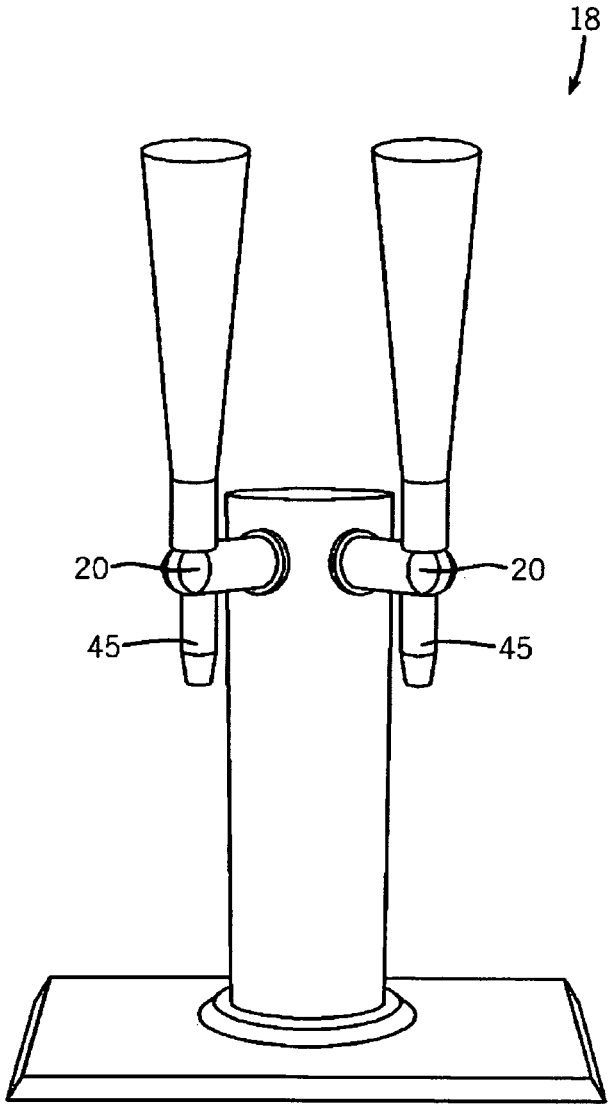
FIG. 2 is a perspective view of a beverage dispenser than can be used with the mixed beverage dispense system of FIG. 1.

The dispenser system 10 of FIG. 1 illustrates four diaphragm pumps 12, 14 to prepare two mixed beverages. The dispenser system 10 of FIG. 1 can lead to a beverage dispenser 18 including two faucets 20, such as those shown in FIG. 2, for dispensing the two mixed beverages. In some embodiments, the dispense system 10 illustrated in FIG. 1 can be used in a back room, while the beverage dispenser 18 is used in a front room of a restaurant, bar, etc. In the back room, the dispense system 10 can be supported by a beverage rack 22, as shown in FIG. 1.

The pumps 12, 14 can be dual diaphragm gas-operated pumps operated using compressed carbon dioxide gas or compressed air via gas lines 23. In some embodiments, the carbon dioxide gas or air can be pressurized between about 60 pounds per square inch (PSI) and about 65 PSI. In some embodiments, the first pump 12 and the second pump 14 can operate using the same input-controlled gas source 24, providing consistent, equal pressure to both the first liquid and the second liquid. The gas lines 23 can be braided beverage tubing with a 0.25-inch inner diameter or other suitable tubing. As shown in FIG. 1, the pumps 12, 14 can be mounted on a rail 25.

Figure 3A:
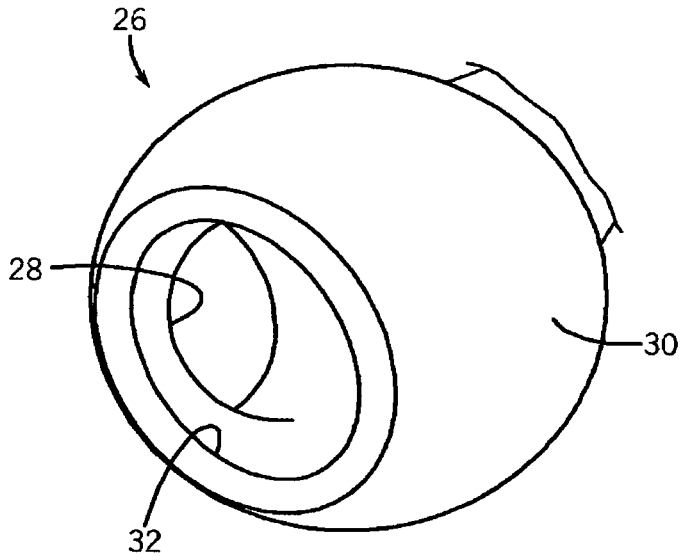
FIGS. 3A-3B are perspective views of a ratio valve according to one embodiment of the invention.
Figure 3B:
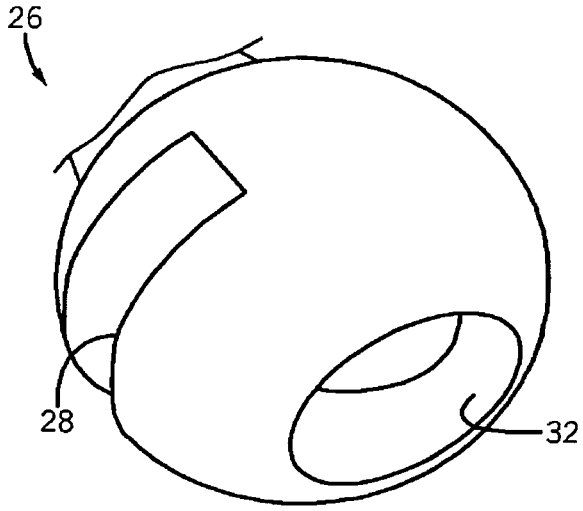
Figure 4:
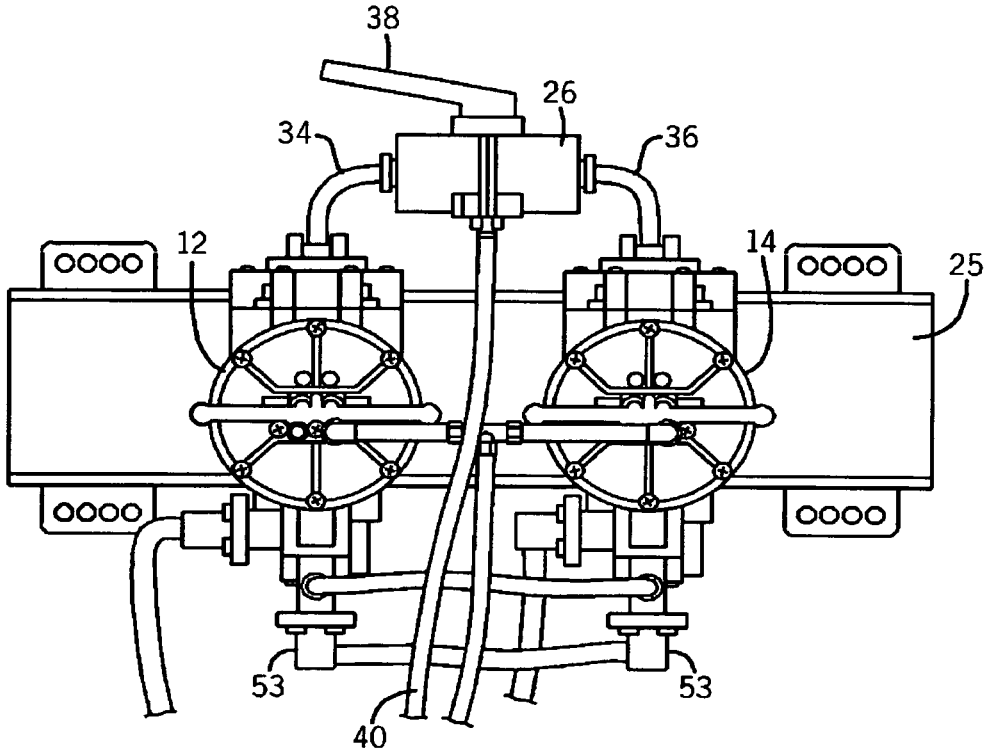
FIG. 4 is a perspective view of a mixed beverage dispense system according to another embodiment of the invention.

In some embodiments, the dispense system 10 can include a ratio valve 26, as shown in FIGS. 3A and 3B. The ratio valve 26 can be a ball valve including two inlets 28, 30 for incoming flows and one outlet 32 for output flow. In the two-inlet ratio valve 26, the first inlet 28 can receive the first liquid from the first pump 12 through a first liquid line 34 (shown in FIG. 4) and the second inlet 30 can receive the second liquid from the second pump 14 through a second liquid line 36 (as also shown in FIG. 4). The first inlet 28 can be a permanent opening and the second inlet 30 can vary in size by adjustment of the ratio valve 26. By adjusting the size of the second inlet 30, the flow of the second liquid can be adjusted. The variable flow of the second inlet 30 can be accomplished with a series of orifices positioned to be progressively exposed as a lever 38 (as shown in FIG. 4) of the ratio valve 26 is adjusted.

In addition, the outlet 32 can be a fixed opening which remains open through the range of the ratio valve adjustment. A mixed beverage including a ratio of the first liquid and the second liquid can exit from the outlet 32, for example, through a mixed beverage line 40 (as shown in FIG. 4) to the beverage dispenser 18. The combination of the pumps 12, 14 providing a fixed and equal pressure to the two liquids and the varying opening of at least the second inlet 30 can provide the ability to accurately adjust the ratio of combined first liquid and second liquid in the mixed beverage being dispensed. In some embodiments, the first liquid line 34, the second liquid line 36, and the mixed beverage line 40 can each be braided beverage tubing with a ⅜-inch inner diameter or other suitable tubing.

In one embodiment, the first inlet 28, which is fixed, can be initially sized based on a smallest ratio desired for the mixed beverage. For example, the first inlet 28 can be sized using the approximate ratio of the mixed beverage when second inlet 30 is fully open. This sizing method can provide the ratio valve 26 with optimal stability for ratio control and repeatability over various flow rates. In some embodiments, more inlets can be included in the ratio valve 26 for a mixed beverage including three or more liquids. Also, in some embodiments, both the first and the second inlets 28, 30 can be adjusted.

Figure 5:
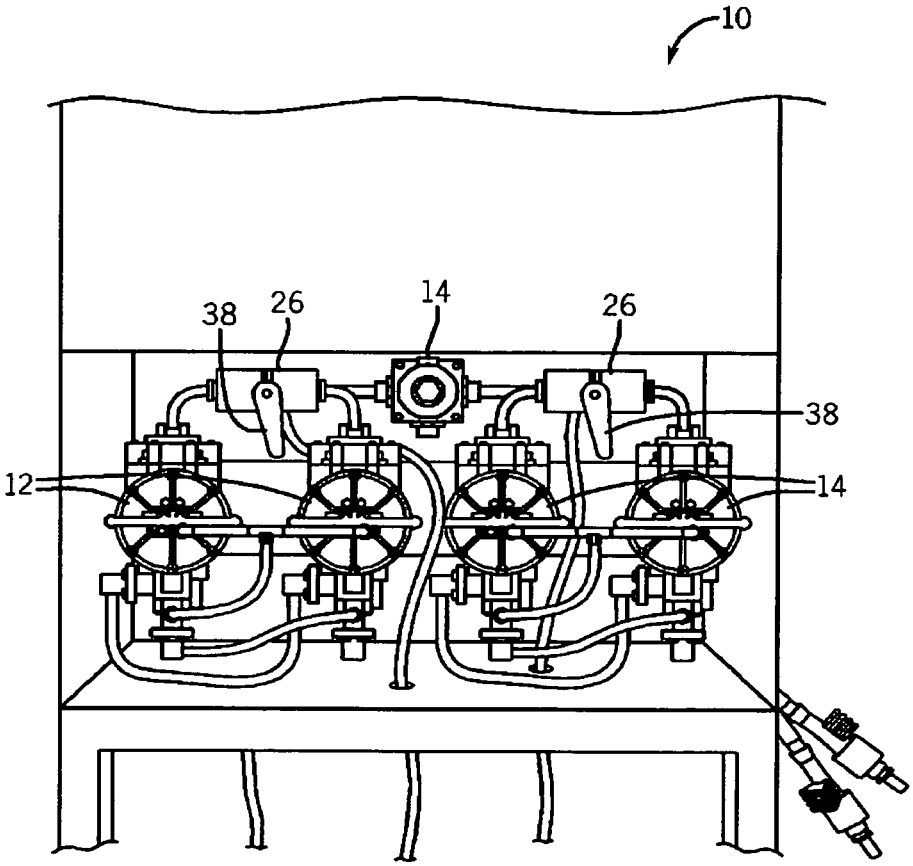
FIG. 5 is a perspective view of a mixed beverage dispense system according to yet another embodiment of the invention.

The ratio valve 26 can be positioned near the pumps 12, 14, as shown in FIG. 4 (e.g., in the back room), or can be positioned closer to the beverage dispenser 18 (e.g., in the front room) for easier ratio adjustment. For example, if a ratio change is made, the mixed beverage line 40 should be flushed of the mixed beverage with the previous ratio. By positioning the ratio valve 26 closer to the point of dispense rather than closer to the pumps, the mixed beverage line 40 is substantially shorter, reducing the wasted beverage when ratio changes are made. FIG. 5 illustrates another embodiment of the dispense system 10.

Figure 6:
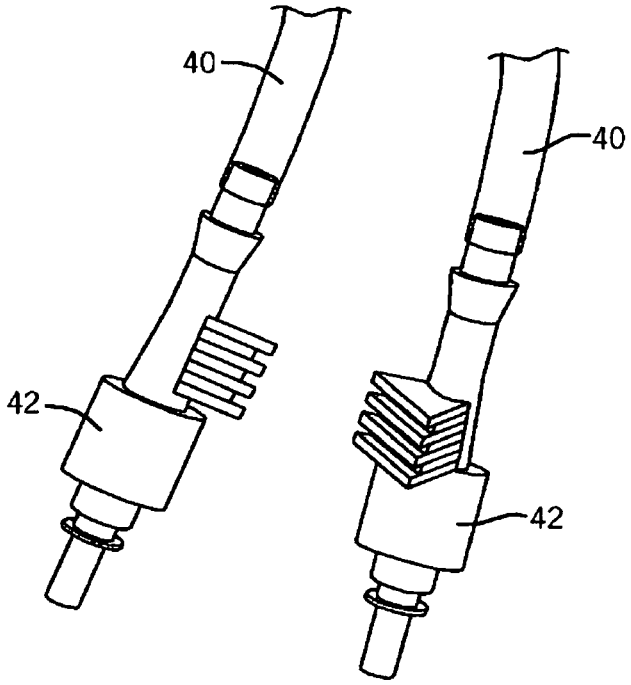
FIG. 6 is a perspective view of flow control valves for use with some embodiments of the invention.

In addition, the dispense system 10 can include one or more flow control valves 42. As shown in FIG. 6, the flow control valves 42 can be connected to the mixed beverage lines 40 to permit flow control of the mixed beverage. The flow control valves 42 can be positioned in the back room and mounted on the beverage rack 22, or in the front room (e.g., below the beverage dispenser 18) for a user to control a flow rate of the mixed beverage.

Figure 7:
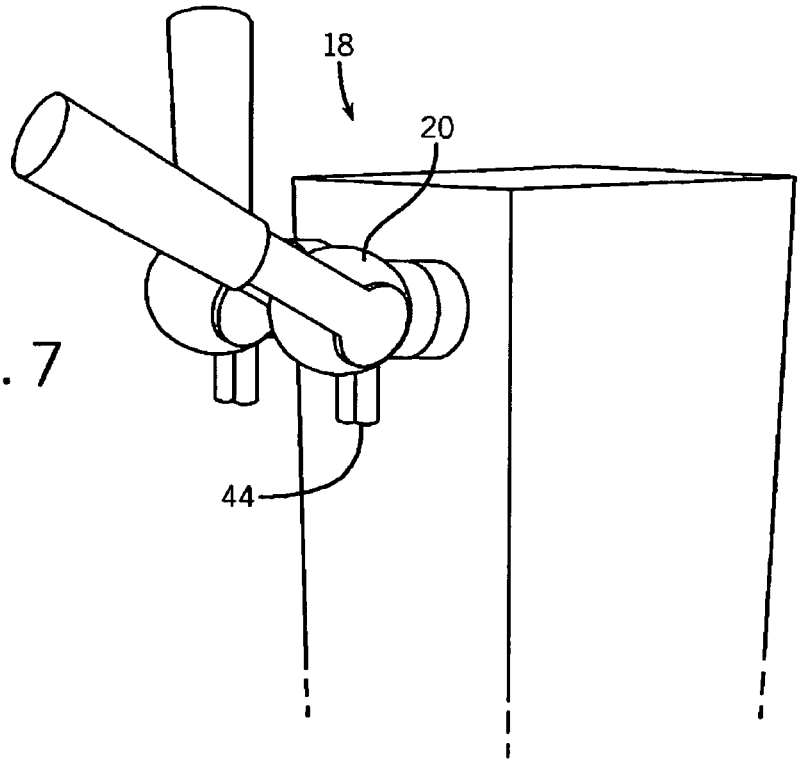
FIG. 7 is a perspective view of a dual outlet valve in a beverage dispenser according to one embodiment of the invention.

In another embodiment, the dispenser system 10 can include a dual outlet valve 44 at the beverage dispenser 18, as shown in FIG. 7. The dual outlet valve 44 can allow the first liquid and the second liquid to be dispensed separately. In some embodiments, a spout (such as spout 45 shown in FIG. 2) can be included over the dual outlet valve 44. Both the first liquid and the second liquid can be dispensed into and mix together inside the spout 45, and the mixed beverage can then exit the spout 45.

Figure 8:
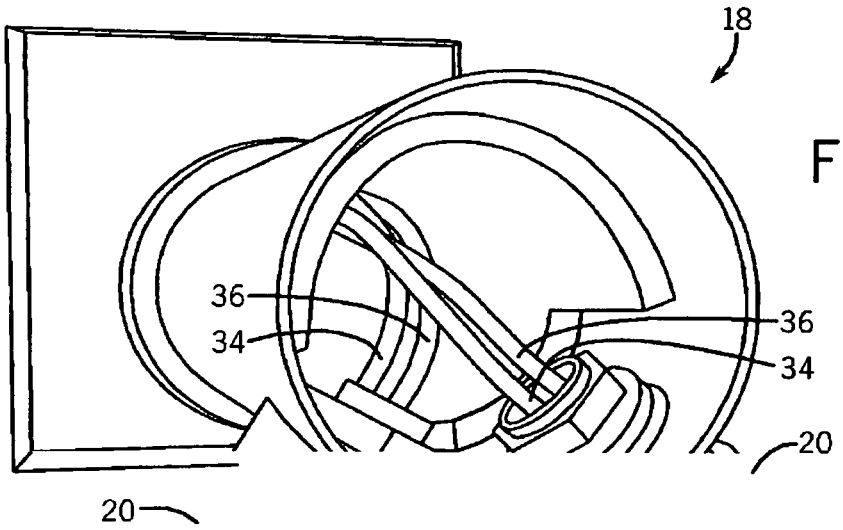
FIG. 8 is a top view of the beverage dispenser of FIG. 7.
Figure 9:
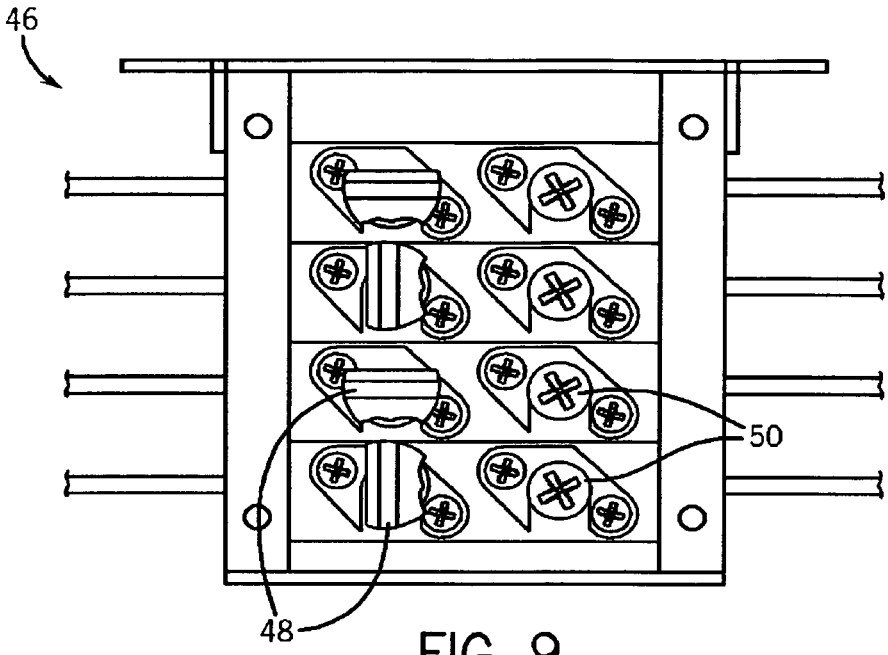
FIG. 9 is a perspective view of a control box used with the dual outlet valve of FIG. 7.
Figure 10:
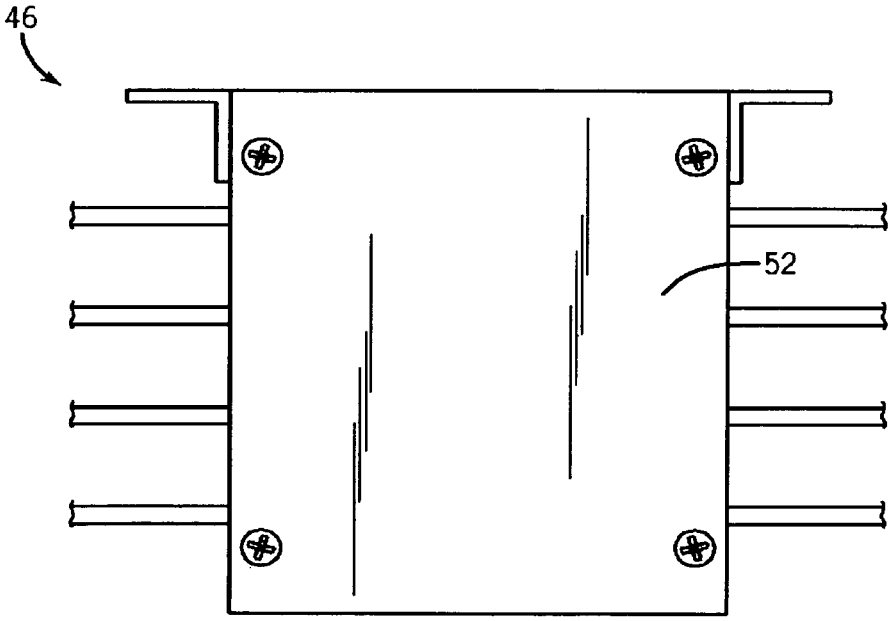
FIG. 10 is another perspective view of the control box of FIG. 9 including a cover.

As shown in FIG. 8, the first liquid line 34 and the second liquid line 36 can be coupled directly to the dual inlet valve 44. The flow of the first liquid and the second liquid can be controlled via a control box 46, as shown in FIG. 9. The control box 46 can include an on/off valve 48 and a ratio valve 50 for each liquid line 34, 36. The on/off valves 48 can permit or restrict flow in the respective liquid line 34, 36. The ratio valves 50 can be used to adjust flow in the respective liquid line 34, 36 by regulating the orifice size of the flow path in the liquid line 34, 36. The ratio valves 50 can be needle valves, torpedo valves, or similar flow limiting valves. Accurate flow control can be achieved through the use of the ratio valves 50 because both liquid lines 34, 36 are being pumped at the same pressure, due to both pumps 12, 14 using the same gas source 24. As a result, a pressure factor does not need to be considered during ratio adjustment because of different flow pressures in the different liquid lines 34, 36. Also, additional pressure compensation devices are not necessary to maintain constant and equal flows in both liquid lines 34, 36. The control box 46 can also include a cover 52, as shown in FIG. 10.

In some embodiments, the control box 46 can be positioned below the beverage dispenser 18 (e.g., underneath a countertop). This can permit easy and accurate ratio control of the mixed beverages at the beverage dispenser 18. In addition, a benefit of the dual outlet valve 44 is that the two liquids are separate until they are finally dispensed. This makes it easier to maintain the liquid lines 34, 36. For example, the second liquid line 36 containing the mixer must be cleaned more often than the first liquid line 34 containing the liquor. If the liquid lines 34, 36 were mixed to form a mixed beverage line (e.g., mixed beverage line 40), then both the second liquid line 36 and the mixed beverage line 40 would need to be cleaned, as well as the first liquid line 34 due to possible contamination from the second liquid line 36.

In some embodiments, as shown in FIG. 4, the dispense system 10 can also include a finished drink flow shut-off mechanism 53. The shut-off mechanism 53 can be used if either the first liquid or the second liquid runs out using a sensed vacuum at an inlet of the pumps 12, 14. In some embodiments, the pumps 12, 14 are shut off (i.e., the shut-off mechanism 53 is activated) because a sensed vacuum causes the pumps 12, 14 to cut off the gas supply from the gas source 24. Failure to shut off the dispense system 10 can result in a continued flow of only one of the first liquid or the second liquid, which may be dispensed for some time before a server realizes one liquid has run out. For example, either all liquor or all mixer could be dispensed to a customer.

In addition, in embodiments where the dispense system 10 includes the ratio valve 26, failure to shut off the cocktail system when a container or bag is empty further creates a problem with out-of-ratio product in the mixed beverage line 40. If the mixed beverage line 40 is longer (e.g., if the ratio valve 26 is in the back room near the pumps rather than closer to the beverage dispenser 18), not having the shut-off mechanism 53 could waste a significant amount of liquor until the beverage system 10 is re-primed with the proper ratio of mixed beverage.

Figure 14:
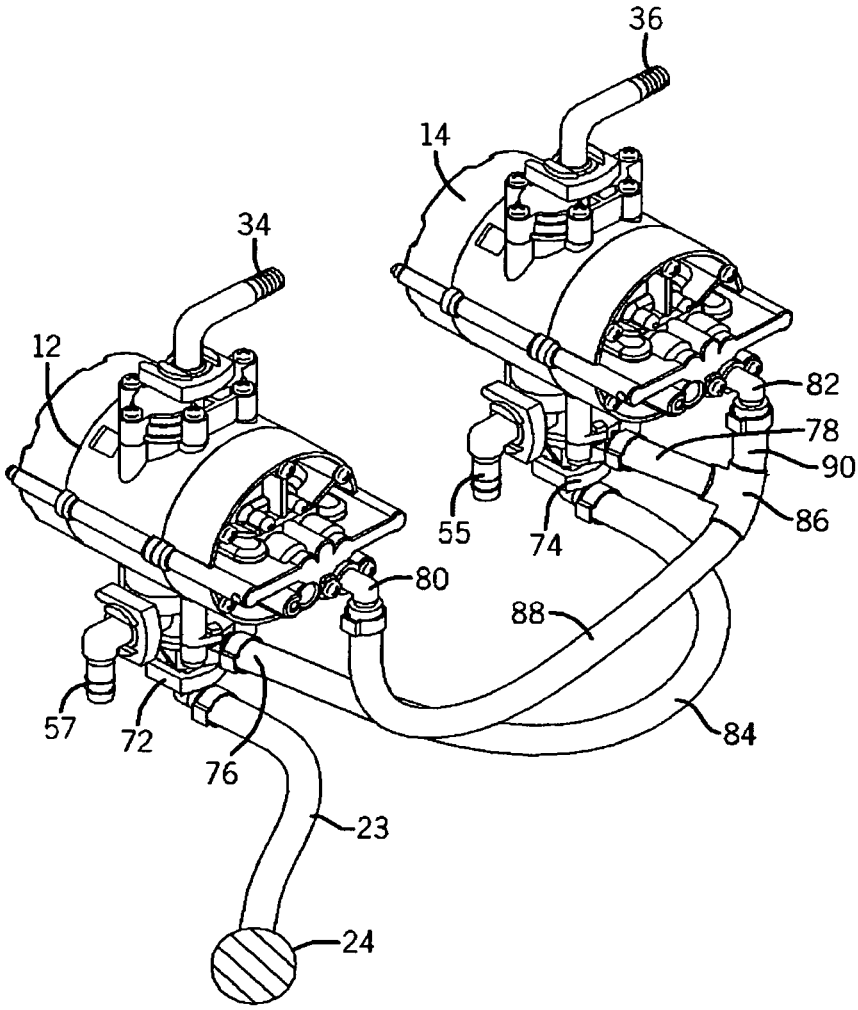
FIG. 14 is a perspective view of two beverage pumps connected to a gas line in series.

When a bag-in-box container goes empty, a vacuum is created at an inlet 55 of the connected pump 14 (as shown in FIG. 14). A standard method of operation is to shut down the pump 14 when the vacuum is sensed. However, when a container open to atmosphere goes empty (e.g., such as liquor in a container well 16), no vacuum is created at an inlet 57 of the connected pump 12. Therefore, a secondary device can be used between the pump 12 and the container well 16 to create a vacuum condition for the pump 12 to shut down. In some embodiments, a liquid shut-off device 54 (as shown in FIG. 11) can be used for this purpose.

Figure 11:
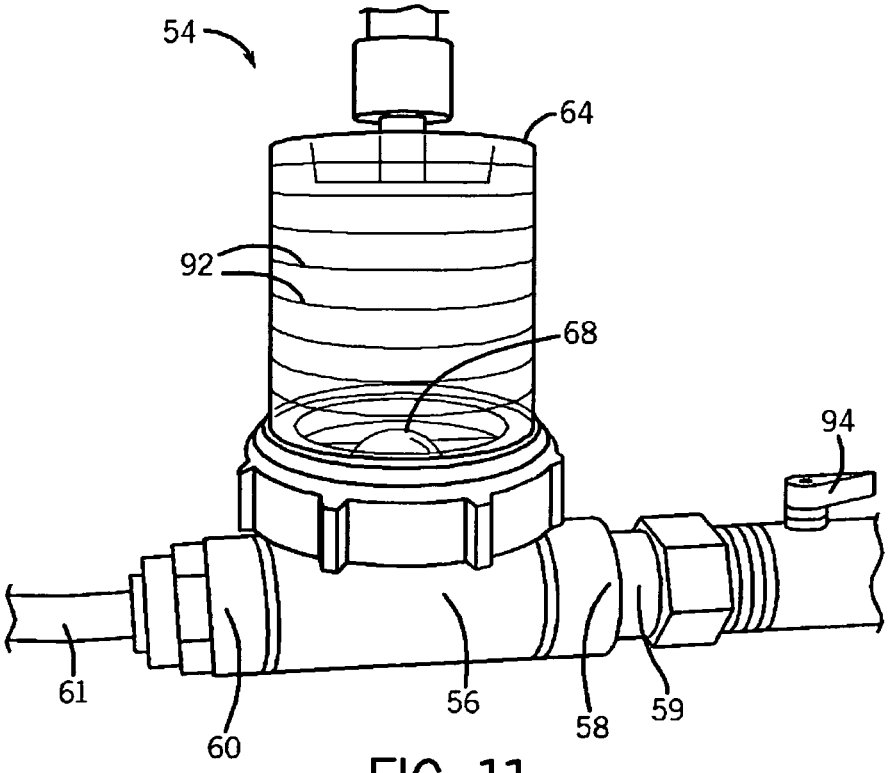
FIG. 11 is a perspective view of a liquid shutoff device according to one embodiment of the invention.
Figure 12A:
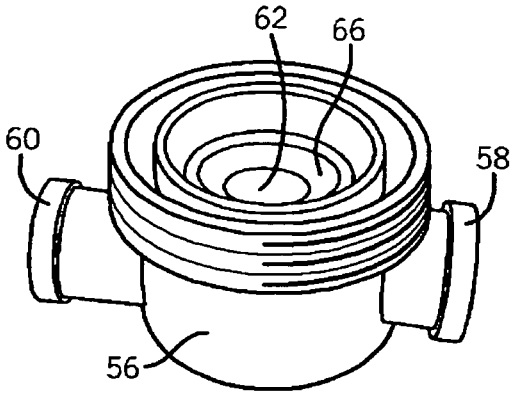
FIGS. 12A-12B are perspective views of a housing of the liquid shutoff device of FIG. 11.
Figure 12B:
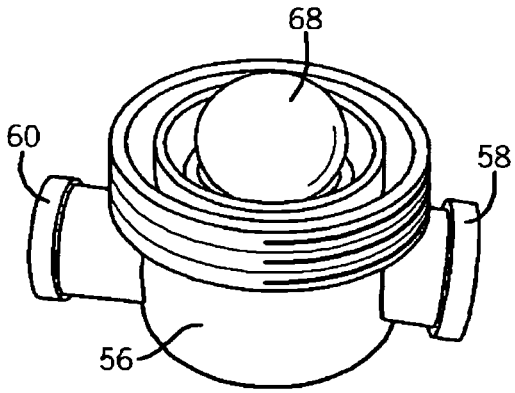

As shown in FIG. 11, the liquid shut-off device 54 can include a housing 56 with an inlet 58 and an outlet 60 forming a flow path for the first liquid. The inlet 58 can be coupled to the container well 16 via tubing 59 and the outlet can be coupled to the first pump 12 via tubing 61. The housing 56 can further include an opening 62 in the flow path, as shown in FIG. 12A. The opening 62 can be in the shape of an annulus. The first liquid in the flow path can enter a clear or opaque plastic bulb 64 (as shown in FIG. 11) through the opening 62, and reach an equilibrium level. The opening 62 can include an o-ring seal 66 around its circumference, which can act as a seal seat (as shown in FIG. 12A). As shown in FIGS. 11 and 12B, a floating sphere 68 can also be included in the plastic bulb 64 and can float on top of the first liquid. When the level of the first liquid drops in the plastic bulb 64 (e.g., when the container well 16 is empty) the sphere 68 can also drop until it sits on the O-ring seal 66 (as shown in FIG. 12B). The sphere 68 on the o-ring seal 66 can create a vacuum to shut off the first pump 12.

Figure 13:
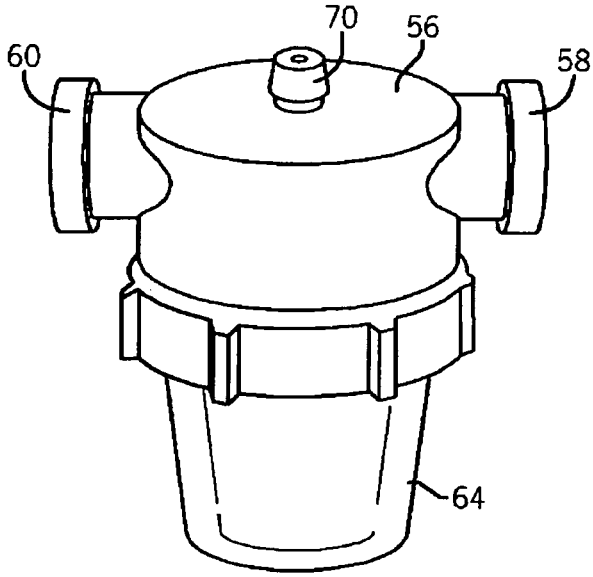
FIG. 13 is a bottom view of the housing of FIGS. 12A-12B.

As shown in FIG. 13, the housing 56 can include a reset button 70. By depressing the reset button 70, the sphere 68 can be dislodged from the vacuum seal seat 66, and if sufficient liquid is again in the plastic bulb 64, the sphere 68 can again float on top of the liquid.

As shown in FIG. 14, the first pump 12 and the second pump 14 can be connected in series to the gas source 24. For example, the first pump 12 and the second pump 14 can include gas inlets 72, 74, first gas connections 76, 78, and second gas connections 80, 82. The first pump 12 can be connected to the gas line 23 at the first gas inlet 72. The first gas connection 76 of the first pump 12 can be connected to the second gas inlet 74 via a line 84. The first gas connection 74 of the second pump 14 can then be connected to a T-connector 86 which can lead to both the second gas connections 80, 82, via lines 88, 90, respectively. The series connection can allow both pumps 12, 14 to shut off should either of the pumps sense a vacuum. Also, in some embodiments, the line leading to the pump with the smaller flow in the beverage system 10 (e.g., the first pump 12 which pumps liquor) can have a smaller diameter for the series shut-off arrangement to operate most effectively.

In embodiments where the dispense system 10 includes the ratio valve 26, the liquid shut-off device 54 of FIGS. 11-13 can also be used for ratio test procedures when the dispense system 10 is installed. For example, the plastic bulb 64 can include graduation marks 92 (as shown in FIG. 11) which represent liquid volume increments. First, the plastic bulb 64 can be filled with an amount of the second liquid, which can be measured using the graduation marks 92 and then flow to the liquid shut-off device 54 can be restricted (e.g., using a shut-off valve 94 near the inlet 58, as shown in FIG. 11). Next, a measured volume of mixed beverage (e.g., a combination of the first and the second liquid) can be dispensed from the beverage dispenser 18 and a comparison can be made between the amount of the second liquid evacuated from the plastic bulb 64 and the amount of the mixed beverage dispensed to determine a ratio of the first liquid and the second liquid in the mixed beverage.

Figure 16:
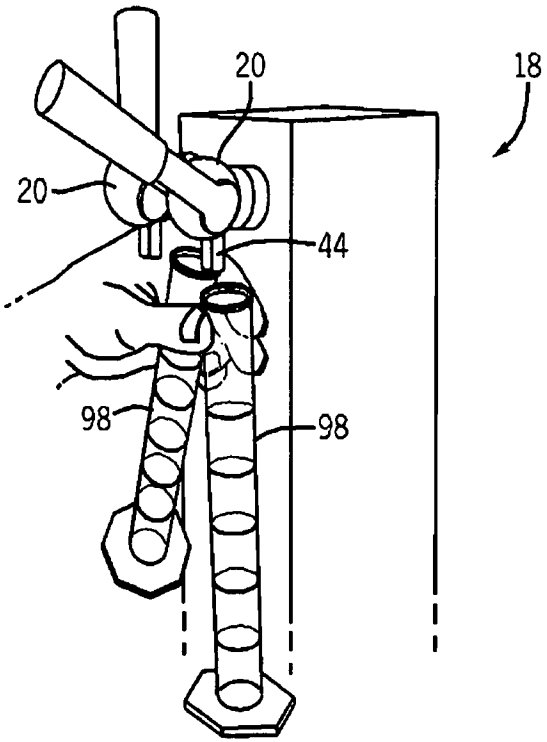
FIG. 16 is a perspective view of a user measuring a ratio of two liquids being dispensed from a beverage dispenser.
Figure 15:
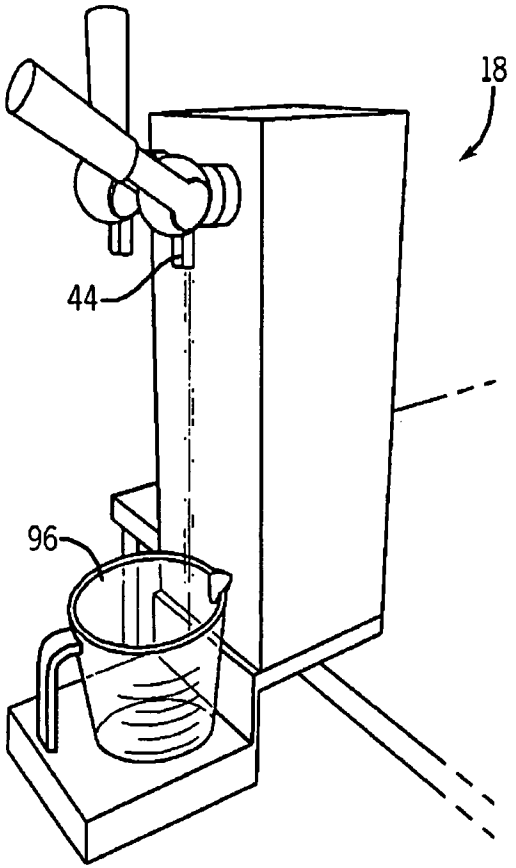
FIG. 15 is a perspective view of a user measuring a flow rate of a liquid being dispensed from a beverage dispenser.

In embodiments where the dispense system 10 includes the dual outlet valve 44, another method can be used for ratio test procedures. First, to achieve an ideal flow of mixer (i.e., the second liquid), the on/off valve 48 (as shown in FIG. 9) for the liquor (i.e., the first liquid) can be turned to an "off" position. A user can then use the beverage dispenser 18 to dispense the mixer into a beaker 96 (as shown in FIG. 15) for 20 seconds or another suitable time period. The user can then adjust the ratio valve 50 (as shown in FIG. 9) for the mixer to obtain 15 ounces of mixer in the beaker 96 in 20 seconds. Once the correct flow rate is obtained, the user can turn the on/off valve 48 for the liquor to an "on" position. Next, the user can remove the spout 45 from the beverage dispenser 18 to access the dual outlet valve 44 (e.g., using an alien wrench). As shown in FIG. 16, the user can place two beakers 98 under each outlet of the dual outlet valve 44. The user can dispense the mixer and liquor separately and measure how much liquid is in each beaker 98. The user can then adjust the ratio valves 50 to achieve a desired ratio (e.g., 3 parts mixer to 1 part liquor). In some embodiments, the user can repeat this process two or more times to ensure accuracy.

Figure 17:
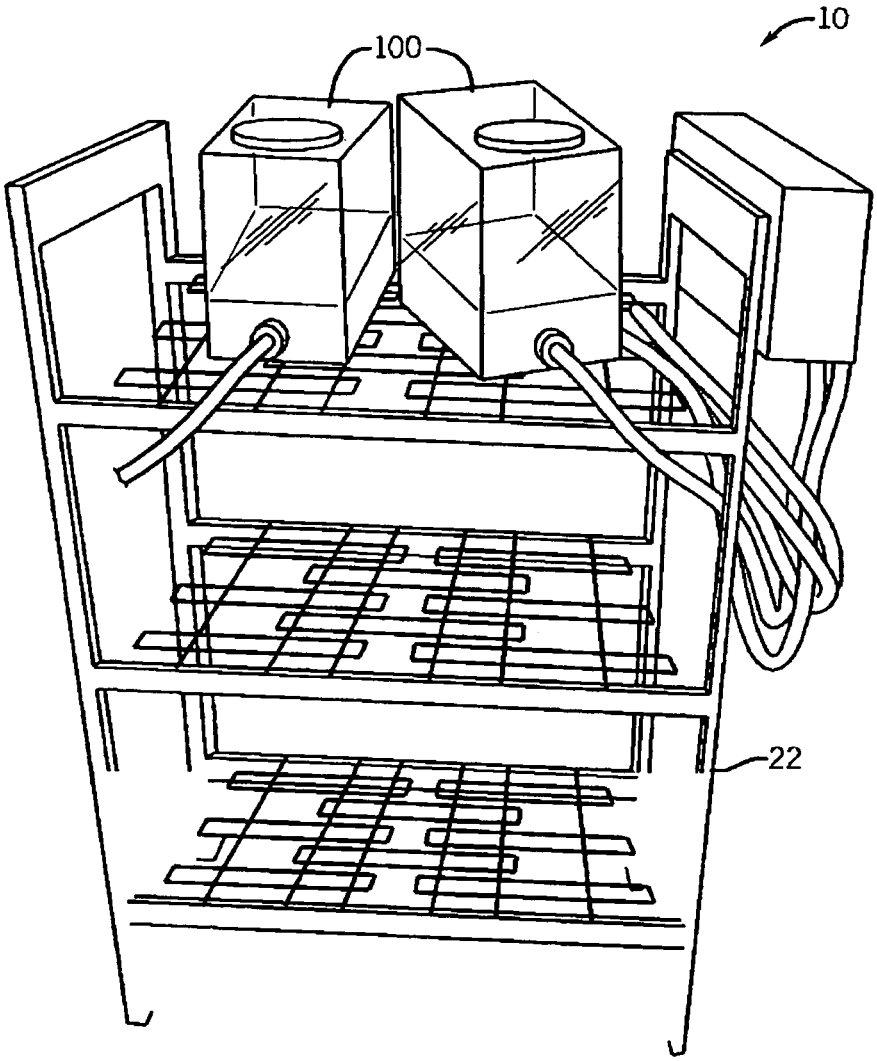
FIG. 17 is a perspective view of a beverage rack supporting large liquor containers.

Current United States Alcohol, Tobacco, Firearms and Explosives (ATF) laws prevent liquor products from being packaged in containers or bags larger than 1.75 liters. After receiving a shipment, multiple 1.75-liter containers can be emptied into larger containers 100 (such as 2.5-gallon containers, as shown in FIG. 17). Using the larger containers 100 can reduce the frequency of container replacement in the beverage system 10.

Figure 18:
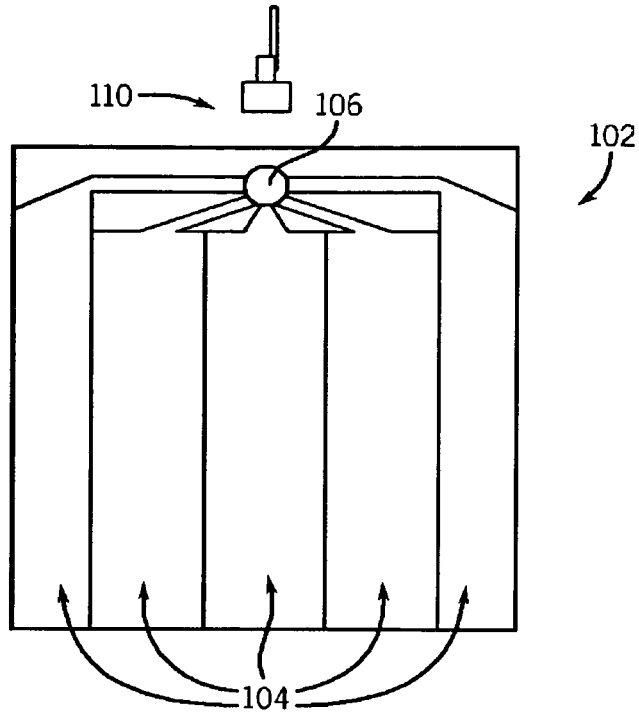
FIG. 18 is a cross-sectional view of a multi-chamber bag-in-box (BIB) package according to one embodiment of the invention.

In other embodiments, as shown in FIG. 18, the dispense system 10 can include a multi-chamber bag-in-box ("BIB") package 102, which can isolate separate chambers 104 for 1.75-liter bags. The BIB package 102 can allow greater volumes of liquor to be shipped in a single box and still comply with the current ATF 1.75 liter requirement.

Figure 19:
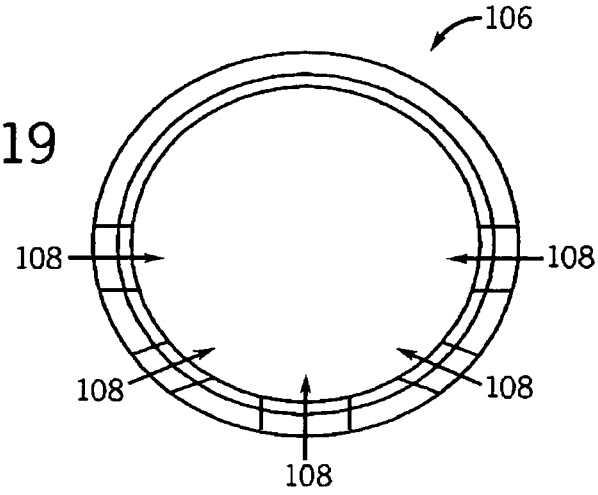
FIG. 19. is a perspective view of an internal fitment used in the multi-chamber BIB package of FIG. 18.
Figure 20:
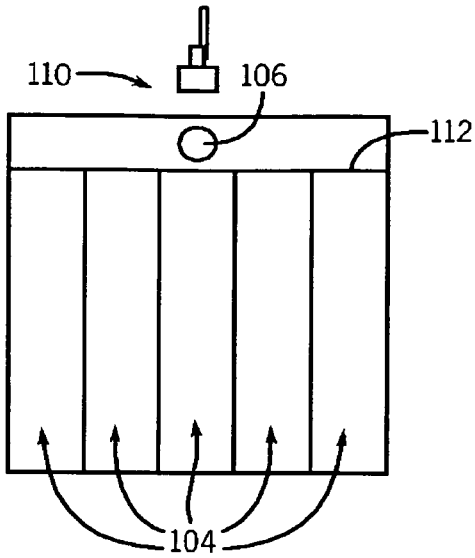
FIG. 20 is another cross-sectional view of the multi-chamber BIB package of FIG. 18.

In one embodiment, the BIB package 102 can be constructed with an internal fitment 106 including fitment openings 108 to each of the chambers 104, as shown in FIGS. 18 and 19. The internal fitment 106 can then be connected to single outlet connector 110. The BIB package 102 can be activated by various methods including crushing, perforating, or removing at least portions of a separation wall 112 (as shown in FIG. 20) allowing the liquid to flow from each chamber into its respective fitment opening 108 and out the single outlet connector 110. A cap (not shown) on the outlet connector 110 can seal all the chambers 104.

Figure 21:
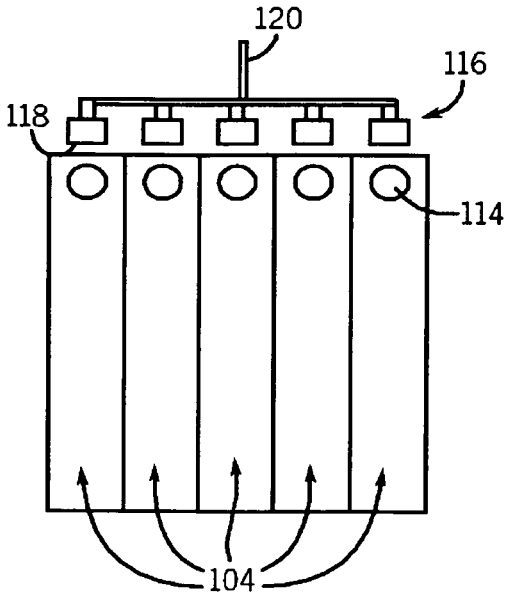
FIG. 21 is a cross-section view of a multi-chamber BIB package according to another embodiment of the invention.

In another embodiment, as shown in FIG. 21, each chamber 104 can include a sealable fitment 114 at its respective opening, allowing each chamber 104 to be opened individually. An outer multi-connector manifold 116 can have multiple inlets 118 connected to each chamber fitment 114 and a single outlet connector 120.

The BIB package 102 can eliminate the need for additional components to activate pump shut-off features when the product containers are emptied, because liquor bags are not open to the atmosphere and thus automatically create a vacuum when empty. In addition, embodiments that include the BIB package 102 in the dispense system 10 eliminate the need to ship bottles of liquor. By shipping liquor bags rather than liquor bottles, less packaging is needed and shipments can be substantially lighter. Fewer bottles being used can help reduce bottle waste (e.g., glass or plastic) in land fills. Further, the dispense system 10 can use one common outlet connector 110 or 120 rather than needing different container wells for liquor bottles of different shapes.

Also, the use of the BIB package 102 can allow for better control of the type of liquor being dispensed. For example, many different liquor bottles can be placed in a container well. However, in one embodiment, liquor manufacturers can use unique connectors 110 or 120, which can prevent the dispensing of other liquor brands in the dispense system 10.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A mixed beverage dispense system for pumping a first liquid and a second liquid using a controlled gas source, the dispense system comprising:

a first pump that pumps the first liquid, the first pump including a first vacuum shutoff device, a first gas inlet, a first inlet gas connection, and a first outlet gas connection;

a second pump that pumps the second liquid, the second pump including a second vacuum shutoff device, a second gas inlet, a second inlet gas connection, and a second outlet gas connection;

first connector tubing connecting the controlled gas source to the first gas inlet;

second connector tubing connecting the first inlet gas connection to the second gas inlet; and third connector tubing connecting the second inlet gas connection to the first outlet gas connection and the second outlet gas connection so that the first pump and the second pump are connected to the controlled gas source in series.

2. The dispense system of claim 1 wherein the third connector tubing further comprises a T-connector.

3. The dispense system of claim 1 and further comprising a beverage dispenser coupled to the first pump and the second pump for dispensing the first liquid and the second liquid.

4. The dispense system of claim 3 and further comprising a ratio adjustment valve coupling the beverage dispenser to the first pump and the second pump, wherein the ratio adjustment valve controls a ratio of the first liquid and the second liquid being dispensed from the beverage dispenser.

5. The dispense system of claim 3 and further comprising a dual outlet valve coupled to the beverage dispenser, the dual outlet valve including a first outlet coupled to the first pump through a first liquid line and a second outlet coupled to the second pump through a second liquid line.

6. The dispense system of claim 5 and further comprising a first ratio valve for adjusting a flow of the first liquid in the first liquid line and a second ratio valve for adjusting a flow of the second liquid in the second liquid line.

7. The dispense system of claim 5 and further comprising a first on/off valve for one of permitting and restricting a flow of the first liquid in the first liquid line and a second on/off valve for one of permitting and restricting a flow of the second liquid in the second liquid line.

8. The dispense system of claim 6 wherein the first ratio valve and the second ratio valve are needle valves.

9. The dispense system of claim 1 wherein the first pump pumps the first liquid from a bag-in-box container.

10. The dispense system of claim 1 wherein the second pump pumps the second liquid from a container well.

11. The dispense system of claim 1 and further comprising a beverage rack for supporting at least the first pump and the second pump.

* * * * *